United States Patent [19]

Todokoro

[11] Patent Number: 4,650,192

[45] Date of Patent: Mar. 17, 1987

[54] SCOOPING GAME TOY

[75] Inventor: Masatoshi Todokoro, Matsudo, Japan

[73] Assignee: Staff Co., Ltd., Tokyo, Japan

[21] Appl. No.: 870,431

[22] Filed: Jun. 4, 1986

[30] Foreign Application Priority Data

Jan. 29, 1986 [JP] Japan ..... 61-11165[U]

[51] Int. Cl.[4] ..... A63F 9/00

[52] U.S. Cl. ..... 273/1 GG; 209/274; 209/326; 209/366.5; 209/367

[58] Field of Search ..... 273/1 GG, 1 G, 1 GC, 273/140, 412; 209/366.5, 367, 326, 325, 332, 274, 275, 276, 277, 278

[56] References Cited

U.S. PATENT DOCUMENTS 951,478 3/1910 Lindsay ..... 209/367 X 2,284,671 6/1942 Meinzer ..... 209/325

2,284,943 6/1942 Brace et al. ..... 209/275

2,509,785 5/1950 Rubin ..... 273/140 X 3,578,319 5/1971 Kohner et al. ..... 273/1 GG 4,121,779 10/1978 Mills et al. ..... 209/358 X

FOREIGN PATENT DOCUMENTS 2121306 12/1983 United Kingdom ..... 273/412

*Primary Examiner*—Paul E. Shapiro

*Attorney, Agent, or Firm*—George B. Oujevolk

[57] ABSTRACT

A game toy wherein a vibrator is incorporated in a scooper for scooping up a model piece of a goldfish or the like put in a vessel, and whereby competition is made for catching the model piece in the condition that the vibrations of the vibrator are propagated to the scooper.

7 Claims, 4 Drawing Figures

SCOOPING GAME TOY

BACKGROUND OF THE INVENTION

1. Field of the Invention

The present invention relates to a scooping game toy, and specifically to a toy which makes it possible to enjoy a game of scooping any one of a plurality of model pieces of a goldfish or the like put in a vessel.

2. Prior Art

Prior-art toys of this kind are so constructed that a model piece of a goldfish or the like is scooped by a scooper formed in imitation of a net or the like.

The model piece lies only in a stationary state on the scooper in a process of being put into a receptacle at hand after it is scooped up, in the aforesaid prior-art toys, and therefore it can not bring about conditions similar to those caused when a living goldfish actually scooped jumps lively on the scooper. This limitation results in a problem that the fun of the game is reduced thereby.

SUMMARY OF THE INVENTION

A first object of the present invention is to furnish a scooping game toy which requires a technique to take a model piece onto a scooping member of a scooper and which increases a fun deriving from a difference in skill in the scooping technique.

A second object of the present invention is to furnish a scooping game toy which brings about conditions with an increased fun that the model piece continues jumping on the scooping member of the scooper in a process of being put into a receptacle at hand after it it scooped up, which are similar to actual conditions in which a living goldfish, when scooped, jumps lively on the scooper.

The above-stated and other objects and characteristics of the present invention will be seen more particularly with reference to attached drawings of illustration and in consideration of the following descriptions.

DETAILED DESCRIPTION

Figure 1:
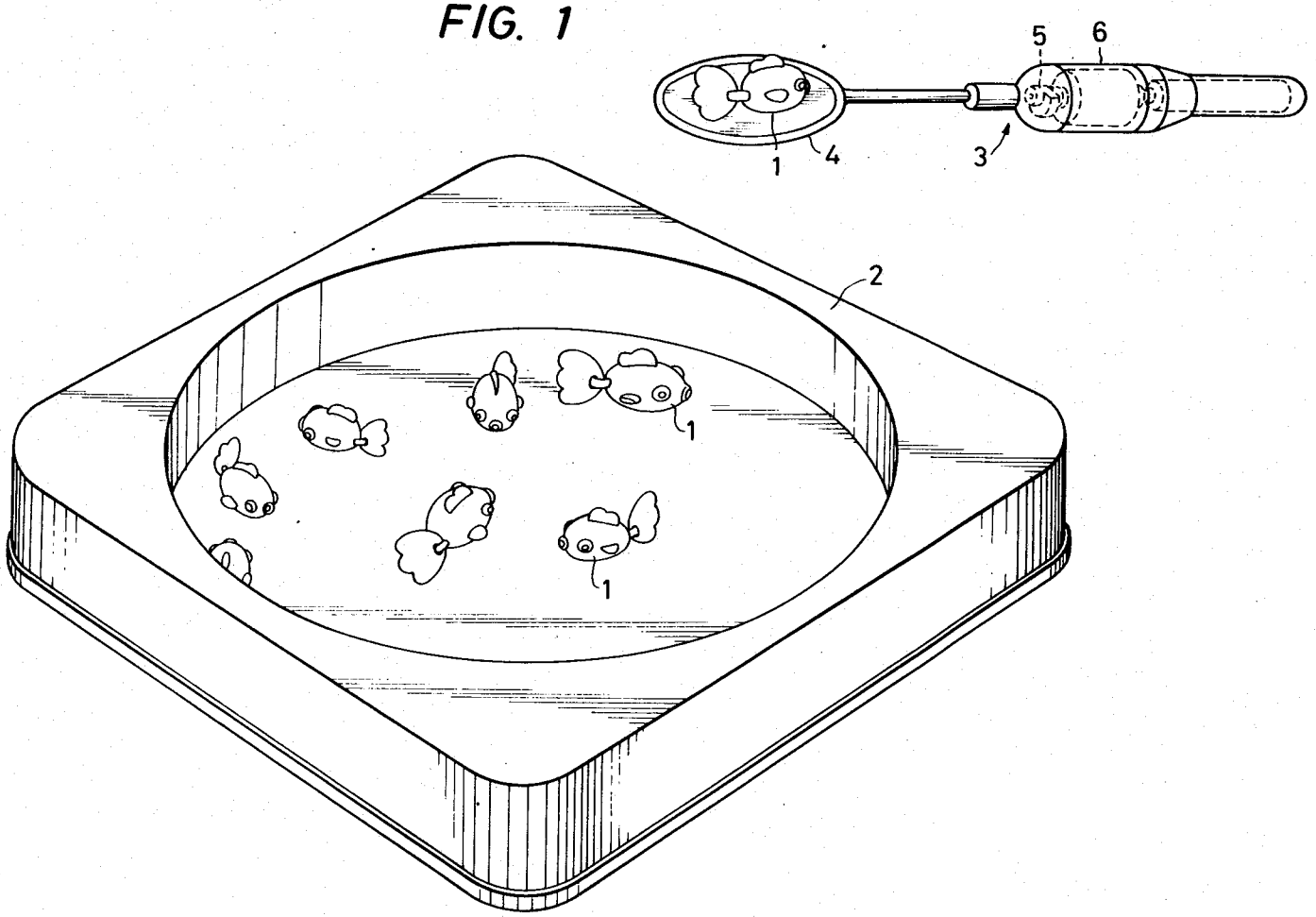
FIG. 1 is a perspective view of the whole of a toy of the present device.

In FIG. 1, numeral 1 denotes a model piece, 2 a vessel with model pieces put therein, and 3 a scooper in which a scooping member 4 for scooping the model piece 1 is connected by a rod 7 to a grip 6 with a vibrator 5 incorporated therein.

As for the model piece 1, various model pieces may be selected appropriately to be employed other than the goldfish model or a goldfish model having a tail and a fin devised to swing.

As for the vessel 2, any one of vessels having a part in which the model piece 1 is put and which is formed in a rectangular or any other shape may be employed other than the vessel having a round-shaped part in which the model piece is put. The bottom surface of the vessel may be designed to have indentation like ripples or any one of other various forms. Moreover, an article provided not only with the part in which the model piece 1 is put, but also with a rotary board which rotates with the model piece 1 put thereon, may be employed as the vessel 2.

As for the scooping member 4, an article whose upper side is formed to be somewhat indented, as well as an article which is provided with many through holes in imitation of meshes of a net, and others, may be employed.

Figure 2:
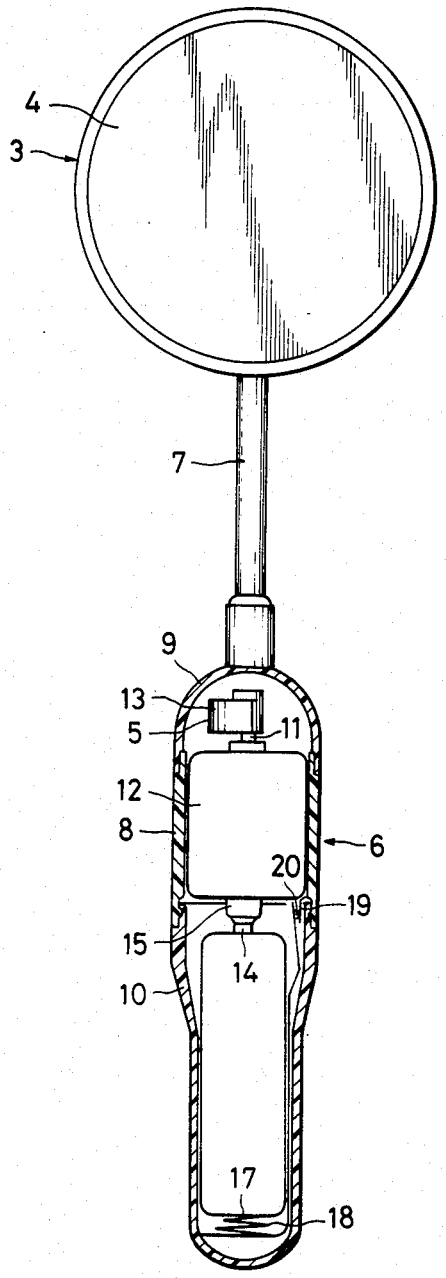
FIG. 2 is a front view of a scooper partly shown as a section.

The grip 6 is composed, as shown in FIG. 2, of a fixed cylinder 8, a cap 9 joined to the front end of the fixed cylinder 8 and connected with the rod 7, and a rotary cylinder 10 joined rotatably to the rear end of the fixed cylinder 8.

Figure 3:
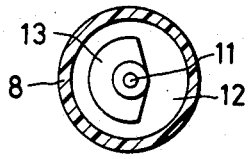
FIG. 3 is an end view on the eccentric weight side of a vibrator.
Figure 4:
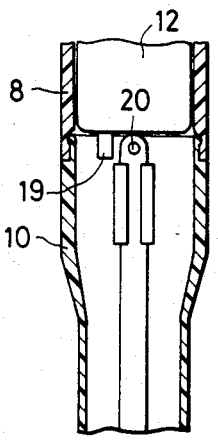
FIG. 4 shows a switching element of the vibrator.

The vibrator 5 is composed, as shown in FIGS. 2 to 4, of a small-sized motor 12 fitted and fixed in the fixed cylinder 8 so that a rotary shaft 11 is directed toward the front end of the grip 6, an eccentric weight 13 fixed to the rotary shaft 11, a battery 16 inserted into the rotary cylinder 10 so that the positive pole 14 thereof contacts with one electrification terminal 15 of the motor 12, and a switch 20 which is connected to the negative pole 17 of the battery 16 through the intermediary of a conductive spring 18 and is put in contact with and separated from the other electrification terminal 19 of the motor 12 with the rotation of the rotary cylinder 10.

Next, a description will be made on the operation of the scooping game toy constructed as described above. A number of model pieces 1 are put in the vessel 2, each competitor for the model pieces 1 holds the scooper 3 in hand, and the vibrator 5 is started by rotating the rotary cylinder 10 to a position at which the switch 20 contacts with the electrification terminal 19. Then the motor 12 is electrified and thereby the rotary shaft 11 is rotated. Simultaneously the eccentric weight 13 is rotated eccentrically to generate minute vibrations, and these minute vibrations of the vibrator 5 are propagated to the scooping member 4. The scooping member 4 is made to approach the model piece 1 under the condition, and when it is put in contact with the model piece 1, the latter is flipped due to the minute vibrations of the former, moving as if it sailed about for escape. The model piece 1 thus moving is taken with skill on the scooping member 4 and brought into a receptacle or the like provided at hand beforehand. In this process, the model piece 1 continues to move, due to the minute vibrations of the scooping member 4, as if a living goldfish continued jumping lively. Therefore, it can not always be brought successfully into the receptacle every time when it is scooped up, but often drops down midway from the scooping member 4.

Thus, a game of competing for catching the model piece 1 can be enjoyed by the repetition of the abovedescribed operation.

I claim:

1. A scooping game toy comprising model pieces, a vessel in which the model pieces are put, and a scooper which is provided with a scooping member for scooping the model pieces and in which a vibrator is incorporated.

2. A scooping game toy according to claim 1, in which each model piece is formed in the shape of a goldfish or the like.

3. A scooping game toy according to claim 1, in which the scooper is so constructed that the scooping member for scooping the model fish is connected by a rod to a grip in which the vibrator is incorporated.

4. A scooping game toy according to claim 3, in which the vibrator is constructed by fixing an eccentric weight to the rotary shaft of a small-sized motor and by connecting a battery to said small-sized motor through the intermediary of a switch.

5. A scooping game toy according to claim 3, in which the grip comprises a fixed cylinder, a cap joined to the front end of the fixed cylinder and connected with the rod, and a rotary cylinder joined rotatably to the rear end of the fixed cylinder.

6. A scooping game toy according to claim 5, in which the rotary cylinder is provided with the switch which is put in contact with and separated from an electrification terminal of the motor.

7. For use with a scooping game toy wherein model pieces resembling fish are placed in a vessel, a scooper for scooping up said model pieces comprising in combination: an elongated grip (6) with a fixed cylinder (8) at the front portion of the grip (6) and a rotary cylinder (10) joined rotatably to the rear end of the fixed cylinder; a small motor (12) fixed in the fixed cylinder (8) with a shaft (11) extending towards the front of the grip (6); an eccentric weight (13) affixed to said shaft (11); a battery receiving section in the rotary cylinder 10 so that a battery when inserted therein can connect with the small motor (12); spring and switch means (18, 20) which when enabled will activate a battery placed in the battery receiving section; a rod (7) extending outwards from the front of the fixed cylinder; and, net means at the end of said rod.

* * * * *